United States Patent [19]

Suzuki

[11] Patent Number: 4,717,709

[45] Date of Patent: Jan. 5, 1988

[54] THERMOSENSITIVE RECORDING MATERIAL

[75] Inventor: Akira Suzuki, Shizuoka, Japan

[73] Assignee: Tomoegawa Paper Manufacturing Co., Ltd., Tokyo, Japan

[21] Appl. No.: 791,808

[22] Filed: Oct. 28, 1985

[30] Foreign Application Priority Data

Nov. 2, 1984 [J.P.] Japan ..... 59-165645
Nov. 2, 1984 [J.P.] Japan ..... 59-165646

[51] Int. Cl.[4] ..... B41M 5/18

[52] U.S. Cl. ..... 503/200; 427/152; 503/226

[58] Field of Search ..... 346/200, 226; 427/152; 503/200, 226

[56] References Cited

FOREIGN PATENT DOCUMENTS 0103892 6/1982 Japan ..... 346/226
0123088 7/1982 Japan ..... 346/226

*Primary Examiner*—Bruce H. Hess

[57] ABSTRACT

Thermosensitive recording material comprising a support, a polyolefin resin layer and a thermosensitive coloring layer, both formed on one side of the support in this order. The thermosensitive coloring layer is made of a dispersion, in a binder, of a colorless or pale-colored leuco dye and an acidic material capable of color formation of the leuco dye when it is heated. When a pressure-sensitive adhesive layer and a release paper are formed on the other side of the support in this order, the thermosensitive recording material can be used as a thermosensitive recording label.

8 Claims, 3 Drawing Figures

THERMOSENSITIVE RECORDING MATERIAL

BACKGROUND OF THE INVENTION

1. Field of the Invention

This invention relates to the art of recording and more particularly, to thermosensitive recording material which is capable of recording an image when it is heated and the once recorded image can be retained as it is over a long period of time even if brought into contact with water, oils, plasticizers or organic solvents.

2. Description of the Prior Art

Typical thermosensitive recording papers are made by applying, onto a porous support such as a paper sheet, a paint of a leuco dye, an acidic material and a binder therefor and drying the paint to form a thermosensitive layer on the support. The thermosensitive paint tends to penetrate into the porous sheet, so that the resulting thermosensitive coloring layer becomes irregular with regard to the thickness. When such a thermosensitive recording sheet is subjected to thermosensitive recording when it is heated such as, for example, letters or a bar cord, an illegible pattern results. Especially, when a bar cord is recorded, the respective lines become discontinuous, showing the tendency that the bar cord is erroneously read. To avoid this, it is the usual practice to apply the paint in large amounts and, after drying, to calender the resulting coloring layer so as to increase the smoothness of the layer. However, these procedures lead to a lowering of the quality of the thermosensitive recording material. In particular, the calendering may result in an undesirable color development of the thermosensitive coloring layer, thus lowering the brightness of the layer.

It is a still further object of the present invention to provide a thermosensitive recording material having a thermosensitive coloring layer in which a high quality coating is uniformly effected.

It is a still further object of the present invention to provide a thermosensitive recording material effecting good adherence between the thermosensitive coloring layer and an under coating layer comprising a polyolefin resin layer and a support sheet.

Although the known thermosensitive recording sheet has a barrier layer of a water-soluble polymer material on the side opposite to the coloring layer in order to prevent the disappearance of a recorded image, the barrier layer cannot be resistant to water when immersed in water over a long period of time and thus the thermosensitive layer may be peeled off. This is true even if the water-soluble polymer material is improved in water resistance by application of a hardening agent thereto.

As is known in the art, one of the main applications of these thermosensitive recording materials is a thermosensitive recording adhesive label. The adhesive label is used for attachment to commercial articles in order to indicate prices, article and shop names, and the like. In these labels, the above-described drawbacks are also involved.

SUMMARY OF THE INVENTION

It is accordingly an object of the present invention to provide a thermosensitive recording material which overcomes the drawbacks of the prior art.

It is another object of the invention to provide a thermosensitive recording material which has a uniform thermosensitive coloring layer involving little or no penetration of a thermosensitive coloring layer into the support sheet upon application thereof.

It is a further object of the invention to provide a thermosensitive recording material which has a very high smoothness of an outer barrier layer and which has a high degree of brightness with a good appearance.

It is a still further object of the invention to provide a thermosensitive recording adhesive label which has improved properties as mentioned above.

According to one embodiment of the invention, there is provided a thermosensitive recording material which comprises a support sheet, and a corona-discharged polyolefin resin layer and a thermosensitive coloring layer, formed on one side of the support sheet in this order. The thermosensitive coloring layer is made of a mixture of a colorless or pale-colored leuco dye and an acidic material capable of coloring the leuco dye when it is heated, in a polymer matrix. A barrier layer of a water-soluble polymer material may be formed on the thermosensitive coloring layer.

Since the corona-discharged polyolefin resin layer is formed on a support sheet, a thermosensitive coloring paint scarcely penetrates into the support sheet. The resulting thermosensitive coloring layer becomes very uniform and dense. The smoothness of the thermosensitive recording material having an outermost barrier layer is as high as about 500 seconds as determined by the Beck smoothness tester and thus no calendering is necessary. This can prevent a lowering of brightness as will be caused by the calendering. The recroding material according to the invention may have a brightness as high as 78 to 82%.

It will be noted here that where a thermosensitive coloring paint is directly applied onto a paper support and the resulting coloring layer is covered with a barrier layer, the Beck smoothness is as low as 100 to 200 seconds. If this type of recording material is subjected to thermosensitive recording, a sharp image cannot be obtained. To avoid this, it is usual to calender the relatively rough recording material so that the smoothness reaches about 500 seconds. The thus calendered material has a brightness of 73 to 76%, which is lower by about 5% than the recording material of this invention. The recording material of the invention having a higher brightness shows a good contrast when an image is recorded, and has a good appearance.

According to another embodiment of the invention, the recording material of the type described above may further comprise an adhesive layer on the opposite side of the support sheet and a releasable backing sheet which is attached to the adhesive layer and can be peeled off as desired, and can thus be used as an adhesive label.

DETAILED DESCRIPTION AND EMBODIMENTS OF THE INVENTION

Figure 1:
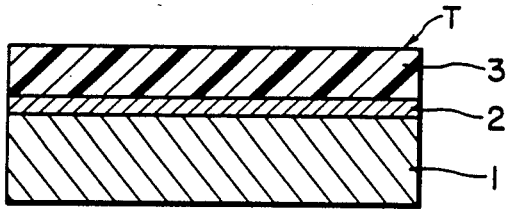
FIG. 1 is a schematic side view of a thermosensitive recording material according to one embodiment of the invention.
Figure 2:
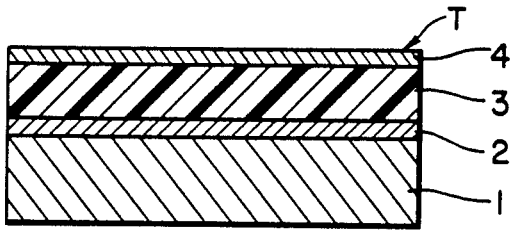
FIG. 2 is a schematic side view similar to FIG. 1.
Figure 3:
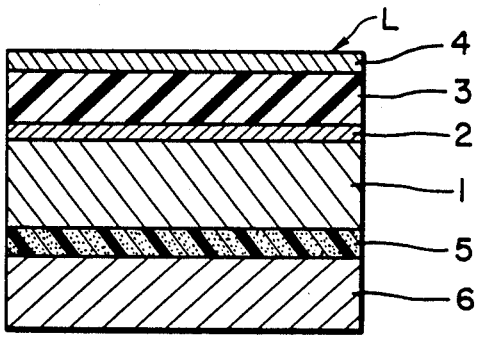
FIG. 3 is a schematic side view of a thermosensitive recording adhesive label according to another embodiment of the invention.

Reference is now made to FIGS. 1 through 3 in which like reference numerals indicate like members. In the FIGS. 1 and 2, there is generally shown a thermosensitive recording material T which includes a support sheet 1, and a corona-discharged polyolefin resin layer 2 and a thermosensitive recording layer 3 formed on the support sheet 1 in this order. In FIG. 2, a barrier layer 4 is further formed on the recording layer 3.

FIG. 3 shows a thermosensitive recording adhesive label L which includes, similarly to FIGS. 1 and 2, the support sheet 1 on which the corona-discharged polyolefin resin layer 2, the thermosensitive recording or coloring layer 3 and the barrier layer 4 are formed on one side of the support sheet 1 in this order. On the opposite side of the support sheet 1 are formed a pressure-sensitive adhesive layer 5 and a releasable paper sheet 6 which can be readily peeled off from the adhesive layer 5.

The support sheet may be any paper sheets ordinarily used for these purposes, such as a high quality paper sheet.

The polyolefin resins used in the practice of the invention include, for example, polyethylene, ethylene-vinyl acetate copolymers, ethylene-acrylic acid copolymers, metal salts of ethylene-methacrylic acid copolymers, ethylene-propylene copolymers, polypropylene and the like. These polyolefin resins are used to form a layer on the support sheet by any known techniques such as lamination, in a thickness of from 5 to 20 μm, preferably from 10 to 15 μm.

The polyolefin resin may comprise a white pigment additive such as, for example, calcium carbonate, titanium dioxide, talc or the like in order to increase the brightness and opacity of the thermosensitive recording material. If added, the white pigment additive is used in an amount of from 5 to 20 wt% of the polyolefin used.

In order to improve the bonding strength to the thermosensitive coloring layer, the polyolefin resin layer should preferably be surface-treated such as by corona discharge as is known in the art.

The present invention is characterized by the formation of the polyolefin resin layer on the support sheet. By this, the thermosensitive coloring layer can be a very uniform, dense layer. In other words, a satisfactory image density can be obtained even when the thermosensitive coloring layer is applied in an amount of about 70% of the case where the thermosensitive coloring layer is directly formed on the support sheet. In addition, the resultant image has a more improved sharpness and uniformity.

In prior art, a barrier layer consisting of a water-soluble polymer material is formed on the side of the support sheet opposite to the recording layer side so as to prevent the loss of a recorded image. According to the present invention, this is achieved by the formation of the polyolefin resin layer. Upon comparison between the barrier layer of a water-soluble polymer material and the polyolefin resin layer with regard to barrier properties against water, oils and plasticizers, the latter is better. In fact, it was confirmed that a recorded image formed on the thermosensitive recording material did not disappear when attacked from the opposite side by means of chemicals.

The thermosensitive recording layer comprises a mixture, in a polymer matrix, of a normally colorless or pale-colored leuco dye and an acidic material through which the leuco dye undergoes the color formation reaction when it is heated. The known leuco dyes, acidic materials and binders used for these purposes are also used in the practice of the invention.

Examples of the leuco dyes include crystal violet lactone, 3-indolino-3-p-dimethylaminophenyl-6-dimethylaminophthalide, 3-diethylamino-7-chlorofluoran, 3-diethylamino-5-ethyl-7-t-butylfluoran, 3-diethylamino-6-methyl-7-anilinofluoran, 3-diethylamino-6-methyl-7-p-butylanilinofluoran, 3-diethylamino-7-dibenzylaminofluoran, 3-cyclohexylamino-6-chlorofluoran, 3-diethylamino-6-methyl-7-xylidinofluoran, 3-pyrrolidino-6-methyl-7-anilinofluoran, 3-pyrrolidino-7-cyclohexylaminofluoran, 3-piperidino-6-methyl-7-toluidinofluoran, 3-pyrrolidino-6-methyl-7-(p-toluidino)fluoran, 3-piperidino-6-methyl-7-anilinofluoran, 3-N-ethylcyclohexylamino-6-methyl-7-anilinofluoran, 3-diethylamino-7-(n-trifluoromethylanilino)fluoran, and the like. These dyes are generally used in an amount of from 5 to 20 wt% of the layer composition.

Examples of the acidic material include organic acidic compounds such as 4-phenylphenol, 4-t-butylphenol, 4-hydroxylacetophenone, alpha-naphthol, beta-naphthol, 2,2'-dihydroxydiphenyl, 2,2'-methylenebis(4-chlorophenol), 2,2'-methylenebis(4-methyl-6-t-butylphenol), methyl-4-hydroxybenzoate, benzyl-4-hydroxybenzoate, 4,4'-isopropylidenebis(2-methylphenol), 4,4'-ethylenebis(2-methylphenol), 1,1'-bis(4'-hydroxyphenyl)-cyclohexane, 4,4'-isopropylidenediphenol, 4,4'-cyclohexylidenebis(2-isopropylphenol), novolac-type phenolic resin, 3-5-di-alphamethylbenzylsalicyclic acid, 4-hydroxybenzoates and mixtures thereof. These acidic materials are generally used in an amount of from 20 to 50 wt% of the layer composition.

The above ingredients are used after mixing with a binder. Examples of the binder include casein, gelatin, styrene-maleic anhydride copolymer, polyvinyl alcohol, modified polyvinyl alcohol, starch, modified starch, isobutylene-maleic anhydride copolymer, diisobutylene-maleic anhydride copolymer, polyacrylamide, modified polyacrylamide, carboxymethyl cellulose, polyvinyl acetate, polystyrene, polyacrylates, vinyl chloridevinyl acetate copolymers, styrene-butadiene copolymers and mixtures thereof.

Aside from these essential ingredients, other additives such as fatty acid amides, white pigments and the like may be added, for improvement of brightness and sensitivity, in amounts not impeding the color formation reaction between the leuco dye and the acidic material when it is heated.

The thermosensitive recording layer is generally formed by preparing a paint of the leuco dye, acidic material and binder in a suitable solvent such as water, coating the paint onto a support sheet in an amount of from 4 to 8 $g/m^2$ on the dry basis, and dried at temperatures which do not cause color formation of the leuco dye, thereby forming the layer on the support sheet.

As mentioned before, a barrier layer may be further formed on the thermosensitive recording layer. For the formation of the barrier layer, water-soluble polymers are used and include, for example, polyvinyl alcohol, polyvinylpyrrolidone, modified polyvinyl alcohol, polyacrylamide, modified polyacrylamide, carboxymethyl cellulose, hydroxyethyl cellulose and the like. If necessary, additives such as metal salts of fatty acids, white pigments, waterproofing agents and the like may be added to the barrier layer.

Any desired image can be formed on the thermosensitive recording or coloring material of the invention by any known thermosensitive recording means including, for example, a thermal recording head.

On the other hand, when the thermosensitive recording adhesive label is made, it is necessary to form an adhesive layer on the side of the support sheet opposite to the polyolefin resin layer side. The adhesives used for these purposes may be any known adhesives including, for example, SBR latice, acrylic adhesives, vinyl acetate adhesives, and other rubber adhesives. On the adhesive layer is formed a releasable paper sheet which has a base sheet and a releasant layer formed thereon. The releasant may be a silicone resin as ordinarily used. The releasable paper sheet is attached to and brought into contact with the adhesive layer. After image formation on the thermosensitive coloring layer, the releasable paper sheet is removed and attached to articles for use as a label.

The present invention is more particularly described by way of examples.

EXAMPLE 1

Preparation of Thermosensitive Recording or Coloring Paint

| | |
|---|---|
| Solution A: | |
| 3-N—methylcyclohexylamino-6-methyl-7-anilinofluoran | 10 parts by weight |
| Polyvinyl alcohol (10% aqueous solution) | 10 parts by weight |
| Water | 10 parts by weight |
| Solution B: | |
| Bisphenol A | 20 parts by weight |
| Calcium carbonate | 20 parts by weight |
| Polyvinyl alcohol (10% aqueous solution) | 10 parts by weight |
| Water | 50 parts by weight |

Solutions A and B were, respectively, dispersed in ball mills for 24 hours. Thereafter, 5 parts by weight of the solution A and 40 parts by weight of the solution B, 5 parts by weight of stearic acid amide (20% suspension), and 15 parts by weight of isobutylene-maleic anhydride copolymer (20% aqueous solution) were mixed to obtain a thermosensitive coloring paint.

Preparation of a Barrier Paint

| Solution C: | |
|---|---|
| Aluminium hydroxide | 15 parts by weight |
| Polyvinyl alcohol (10% aqueous solution) | 15 parts by weight |
| Water | 18 parts by weight |

The above mixture was dispersed in a ball mill for 24 hours. Thereafter, 3 parts by weight of the solution C, 70 parts by weight of polyvinyl alcohol (10% aqueous solution), 5 parts by weight of polyamide resin, and 2 parts by weight of a metal salt of fatty acid (20% suspension) were mixed to obtain a barrier paint.

A 13 μm thick polyethylene resin film was laminated on the high quality paper having a basis weight of 50 g/m$^2$. On the film was applied the thermosensitive coloring paint in an amount of 5.5 g/m$^2$ on the solid basis and dried. Subsequently, the barrier paint was further applied onto the dried layer in an amount of 4 g/m$^2$ on the solid basis and dried to obtain a thermosensitive recording sheet.

COMPARATIVE EXAMPLE 1

The thermosensitive coloring paint as obtained in Example 1 was applied onto a high quality paper having a basis weight of 55 g/m$^2$ in an amount of 8.0 g/m$^2$ on the solid basis, dried, followed by further application of a barrier paint as used in Example 1 in an amount of 4 g/m$^2$ on the solid basis and drying. On the opposite side of the high quality paper was coated the barrier paint as used above in an amount of 5 g/m$^2$ on the solid basis, followed by drying and calendering to obtain a thermosensitive recording sheets for comparison.

The thermosensitive recording sheets obtained above were, respectively, subjected to measurements of a static color-forming characteristic using a heat-gradient record tester (made by Toyo Seiki K.K.) and a dynamic color-forming characteristic using a printer (Model BP-70, by Teraoka K.K.). The results are shown in Table 1 along with Beck's smoothness and brightness.

TABLE 1

| | Ex. 1 | Com. Ex. 1 |
|---|---|---|
| Amount of coloring layer (g/m$^2$) | 5.5 | 8.0 |
| Smoothness (seconds) | 520 | 600 |
| Brightness (%) | 80.3 | 73.6 |
| Static recording characteristic (*1) | 1.40 | 1.41 |
| Dynamic recording characteristic (*2) | good | fair |

(*1) Color density under conditions of a press pressure of 1 kg, a contact time of 3 seconds, and a temperature of 120° C.
(*2) Resolution of a recorded image.

Moreover, the resistance of a recorded image on each recording material to water, an oil, a plasticizer and an alcohol was determined in terms of an image density measured by means of the Macbeth densitometer RD-514. The results are shown in Table 2 below.

TABLE 2

| | Ex. 1 | Com. Ex. 1 |
|---|---|---|
| Density of colored Sample | 1.40 | 1.41 |
| Immersed in water at 20 degrees C. for 48 hours | 1.27 | 1.26 |
| Applied with cotton seed oil on the record surface and allowed to stand at 20 degrees C. for 48 hours | 1.72 | 1.70 |
| Applied with cotton seed oil on the opposite side to the record surface and allowed to stand at 20 degrees C. for 48 hours | 1.34 | 1.28 |
| Applied with plastic eraser on the record surface under a load of 100 g and allowed to stand at 20 degrees C. for 48 hours | 1.24 | 1.25 |
| Applied with plastic eraser on the opposite side to the record surface under a load of 100 g and allowed to stand at 20 degrees C. for 48 hours | 1.38 | 1.32 |

EXAMPLE 2

A polyethylene resin was laminated on a high quality paper having a basis weight of 50 g/m$^2$ in a thickness of 13 μm and then subjected to corona discharge so that a wet index was 40 dynes/cm as determined by a method prescribed in JIS K 6768/1977. A thermosensitive coloring paint as used in Example 1 was applied onto the corona-discharged surface in an amount of 5.5 g/m$^2$ and after drying, a barrier paint as used in Example 1 was applied onto the resultant layer in an amount of 4 g/m$^2$ on the solid basis and dried to obtain a thermosensitive recording material. This material was found to have substantially the same resistances to water, oil, plasticizer and alcohol and to have a much improved strength of bonding between the thermosensitive recording layer and the barrier layer.

EXAMPLE 3

The general procedure of Example 1 was repeated except that the high quality paper which had a 13 μm thick polyethylene resin film laminated on one side thereof, was provided with a pressure-sensitive adhesive layer and a release paper on the opposite side, thereby obtaining a thermosensitive recording adhesive label.

COMPARATIVE EXAMPLE 2

Comparative Example 1 was repeated except that an pressure-sensitive adhesive layer and a release paper were first formed on one side of the high quality paper and then the thermosensitive coloring layer and the barrier layer were formed on the opposite side, thereby obtaining a thermosensitive recording adhesive label.

The labels obtained in Example 3 and Comparative Example 2 were tested similar to Example 1 with similar results.

What is claimed is:

1. A thermosensitive recording material comprising: a support sheet; a polyolefin resin layer; and a thermosensitive coloring layer formed on one side of said support sheet in this order; said thermosensitive coloring layer comprising a normally colorless or pale-colored leuco dye and an acidic material capable of coloring said leuco dye upon being heated; said polyolefin resin layer being corona-discharge treated in order to improve the adhesion of said thermosensitive coloring layer to said polyolefin resin layer.

2. A thermosensitive recording material according to claim 1, wherein said polyolefin resin layer has a thickness of from 5 to 20 μm and is formed by lamination.

3. A thermosensitive recording material according to claim 1, wherein said polyolefin resin layer further comprises a white pigment in an amount of from 5 to 20 wt% of the polyolefin resin.

4. A thermosensitive recording material according to claim 1, further comprising a barrier layer consisting essentially of a water-soluble polymeric material and formed on said thermosensitive coloring layer.

5. A thermosensitive recording material according to claim 4, further comprising a pressure-sensitive adhesive layer and a releasable sheet formed on the opposite side of said support sheet in this order whereby said recording material can be used as a thermosensitive recording adhesive label.

6. A thermosensitive recording material according to claim 1, further comprising a pressure-sensitive adhesive layer and a releasable sheet formed on the opposite side of said support sheet in this order whereby said recording material can be used as a thermosensitive recording adhesive label.

7. A thermosensitive recording material according to claim 1 wherein the support sheet does not have a barrier layer directly thereon.

8. The thermosensitive recording material of claim 1 wherein the thermosensitive coloring layer also comprises binder ingredient.

* * * * *